US006241147B1

(12) United States Patent
Guidera

(10) Patent No.: US 6,241,147 B1
(45) Date of Patent: Jun. 5, 2001

(54) POUCH FOR A WEDGE-SHAPED COSMETIC FOUNDATION SPONGE

(76) Inventor: Debra Ann Guidera, 38 Moonachie Rd. #308, Hackensack, NJ (US) 07601

( * ) Notice: Subject to any disclaimer, the term of this patent is extended or adjusted under 35 U.S.C. 154(b) by 0 days.

(21) Appl. No.: 09/246,586

(22) Filed: Feb. 8, 1999

(51) Int. Cl.[7] ..... B65D 5/42
(52) U.S. Cl. ..... 229/112; 206/438; 229/162
(58) Field of Search ..... 229/112, 152, 229/153, 162; 206/438, 581, 823; 220/62, 602, 665

(56) References Cited

U.S. PATENT DOCUMENTS

| | | | | |
|---|---|---|---|---|
| D. 250,548 | | 12/1978 | Rost | D28/79 |
| 879,488 | * | 2/1908 | Pitkin | 229/112 |
| 1,669,139 | * | 5/1928 | Martin | 229/112 |
| 1,931,293 | * | 10/1933 | Morck | 229/112 |
| 2,141,752 | * | 12/1938 | Hoarle | 229/162 |
| 2,337,199 | * | 12/1943 | Holy | 229/112 |
| 2,500,338 | * | 3/1950 | Bergstein | 229/162 |
| 2,931,550 | * | 4/1960 | Wood | 229/112 |
| 4,461,332 | | 7/1984 | Parkhurst | 150/34 |
| 4,722,462 | * | 2/1988 | Zinnbauer | 206/823 |
| 4,739,879 | | 4/1988 | Nakamura | 206/205 |
| 4,998,838 | | 3/1991 | Cancelosa et al. | 401/202 |
| 5,161,556 | | 11/1992 | Audebourg et al. | 132/296 |

* cited by examiner

*Primary Examiner*—Gary E. Elkins
(74) *Attorney, Agent, or Firm*—Richard L. Miller

(57) ABSTRACT

A pouch for a wedge-shaped cosmetic foundation sponge that includes a back panel, a pair of side panels that extend from the back panel, a front panel that extends across the pair of side panels, a bottom panel that extends across the pair of side panels, the back panel, and the front panel, a top that is open and extends across the pair of side panels, the front panel, and the back panel for allowing entry of the wedge-shaped cosmetic foundation sponge, and a flap that selectively opens and closes the top. The pouch is acetate with heat sealed affixed edges. The back panel is generally rectangular-shaped. Each side panel of the pair of side panels is generally trapezoidal-shaped. The front panel is generally rectangular-shaped. The bottom panel is generally rectangular-shaped. The flap has a first portion that is generally rectangular-shaped and bendable to selectively cover the top and a second portion that is bendable, tapered, insertable through the top, and frictionally positionable against the front panel for maintaining the wedge-shaped cosmetic foundation sponge therein.

22 Claims, 1 Drawing Sheet

FIG. 1
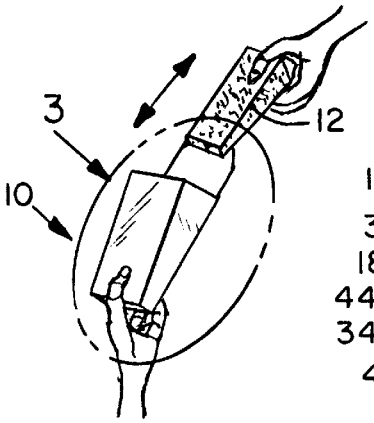
FIG.3
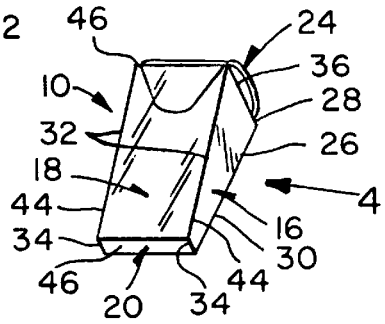
FIG.2
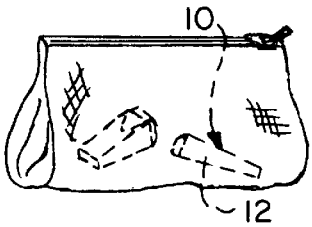
FIG.4
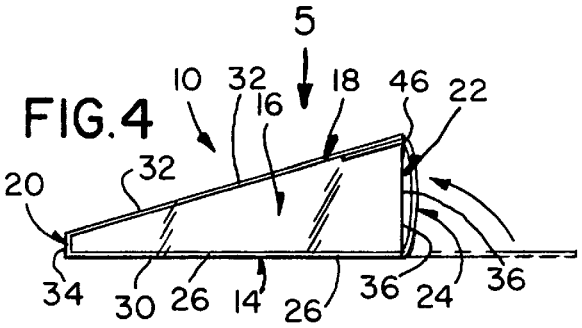
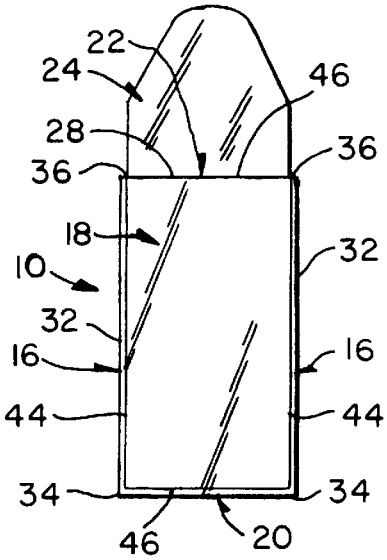
FIG.5
FIG.6
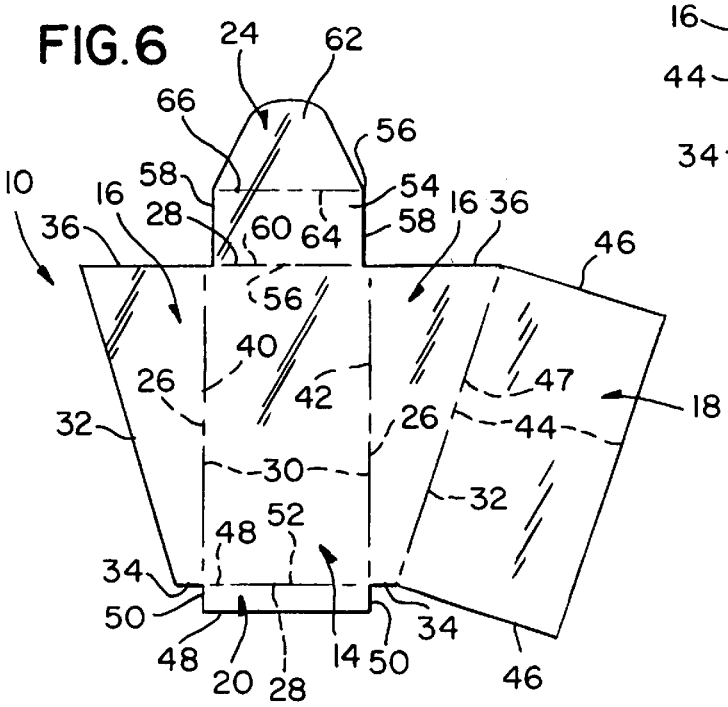

POUCH FOR A WEDGE-SHAPED COSMETIC FOUNDATION SPONGE

BACKGROUND OF THE INVENTION

1. Field of the Invention

The present invention relates to a pouch. More particularly, the present invention relates to a pouch for a wedge-shaped cosmetic foundation sponge.

2. Description of the Prior Art

A cosmetic foundation sponge is used to apply bottled foundation makeup. After use, it is wet and saturated with makeup and gets all over other makeup in a makeup bag, plus the makeup bag itself.

Numerous innovations for makeup related devices have been provided in the prior art that will be described. Even though these innovation- may be suitable for the specific individual purposes to which they address, however, they differ from the present invention.

A FIRST EXAMPLE U.S. Pat. No. Des. 250,548 to Rost teaches the ornamental design for a make-up case.

A SECOND EXAMPLE, U.S. Pat. No. 4,461,332 to Parkhurst teaches a cosmetic bag or case for carrying cosmetic articles and the like. The bag can be any shape or size. The illustrated bag includes a top cover and a bottom cover, which can be hinged together. These covers can be made of plastic, cloth, or some other suitable, flexible or rigid material. A hook and loop strap member extends across at least part of this cover on the interior of the bag. A second hook and loop strap is adapted for mating engagement with the first strap. Padding is located adjacent the hook and loop straps. When a cosmetic article is secured between the first and second hook and loop straps, the article resiliently and frictionally engages the padding, and is thus retained in a substantially immobile position within the cosmetic bag.

A THIRD EXAMPLE, U.S. Pat. No. 4,739,879 to Nakamura teaches a re-sealable dispenser container and a process for producing the container. The dispenser-container comprises a main container body made of impervious material with at least one opening, a flap having a pressure-sensitive adhesive surface and fixed to the main body at one end thereof to cover the opening, and a non-adhesive member adhered to the adhesive surface and which member is used for closing the opening in order to prevent the adhesive surface from directly contacting the contents. The process comprises punching a perforated line in a sheet used for the main body, disposing a flap on the sheet so as to cover the perforated line, fixing one end of the flap to the sheet, and sealing the sheet longitudinally and transversely. The dispenser-container contains two fluidly isolated chambers, one for containing a first type of wet tissues and the other containing a second, different type of wet tissues.

A FOURTH EXAMPLE, U.S. Pat. No. 4,998,838 to Cancelosa et al. teaches a dispenser for the convenient application of a liquid facial cover make-up that has means for the daubing and blending of the make-up without the user's fingers having to touch the make-up. The dispenser comprises a container for holding the liquid cover make-up, a reservoir base positioned on the container and having an opening therethrough so as to be in communication with the container's contents, an applicator sponge positioned in the reservoir base with a retainer sleeve to hold it permanently in place, a blender pad base and blender pad removably positioned over the applicator sponge and a cover cap removably positioned over the blender pad base.

A FIFTH EXAMPLE, U.S. Pat. No. 5,161,556 to Audebourg et al. teaches a make-up box comprising a case constructed of two case parts articulated one on the other, a mirror being arranged in a first case part and a platform bearing one or more make-up products on one of its faces being arranged in the second case part. The second case part is at least partially transparent and the platform is arranged so as to be movable and rotatable through 180 degrees in the said second case part so as to be able to occupy two positions such that the make-up products supported by the platform may be turned towards the second case part in a first position and turned toward the first case part in the second position.

It is apparent that numerous innovations for makeup related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a pouch for a wedge-shaped cosmetic foundation sponge that avoids the disadvantages of the prior art.

ANOTHER OBJECT of the present invention is to provide a pouch for a wedge-shaped cosmetic foundation sponge that is simple and inexpensive to manufacture.

STILL ANOTHER OBJECT of the present invention is to provide a pouch for a wedge-shaped cosmetic foundation sponge that is simple to use.

BRIEFLY STATED, YET ANOTHER OBJECT of the present invention is to provide a pouch for a wedge-shaped cosmetic foundation sponge that includes a back panel, a pair of side panels that extend from the back panel, a front panel that extends across the pair of side panels, a bottom panel that extends across the pair of side panels, the back panel, and the front panel, a top that is open and extends across the pair of side panels, the front panel, and the back panel for allowing entry of the wedge-shaped cosmetic foundation sponge, and a flap that selectively opens and closes the top. The pouch is acetate with heat sealed affixes edges. The back panel is generally rectangular-shaped. Each side panel of the pair of side panels is generally trapezoidal-shaped. The front panel is generally rectangular-shaped. The bottom panel is generally rectangular-shaped. The flap has a first portion that is generally rectangular-shaped and bendable to selectively cover the top and a second portion that is bendable, tapered, insertable through the top, and frictionally positionable against the front panel for maintaining the wedge-shaped cosmetic foundation sponge therein.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures on the drawing are briefly described as follows:

FIG. 1 is a diagrammatic perspective view of a wedge-shaped cosmetic foundation sponge being inserted into the present invention;

FIG. 2 is a diagrammatic perspective view of the present invention with the wedge-shaped cosmetic foundation sponge therein being carried in a hand bag;

FIG. 3 is a diagrammatic perspective view of the area generally enclosed by the dotted curve identified by arrow 3 in FIG. 1 of the present invention;

FIG. 4 is an enlarged diagrammatic side elevational view taken generally in the direction of arrow 4 in FIG. 3;

FIG. 5 is a diagrammatic top plan view taken generally in the direction of arrow 5 in FIG. 4; and FIG. 6 is a diagrammatic flat pattern used to fabricate the present invention.

LIST OF REFERENCE NUMERALS UTILIZED IN THE DRAWING

10 pouch for a wedge-shaped cosmetic foundation sponge of the present invention
12 wedge-shaped cosmetic foundation sponge
14 back panel
16 pair of side panels
18 front panel
20 bottom panel
22 open top for allowing entry of wedge-shaped cosmetic foundation sponge 12
24 flap selectively opening and closing top 22
26 pair of longitudinal edges of back panel 14
28 pair of lateral edges of back panel 14
30 short longitudinal edge of each side panel of pair of side panels 16
32 long longitudinal edge of each side panel of pair of side panels 16
34 short lateral edge of each side panel of pair of side panels 16
36 long lateral edge of each side panel of pair of side panels 16
40 first bend line
42 second bend line
44 pair of longitudinal edges of front panel 18
46 pair of lateral edges of front panel 18
47 third bend line
48 pair of lateral edges of bottom panel 20
50 pair of longitudinal edges of bottom panel 20
52 fourth bend line
54 first portion of flap 24
56 pair of lateral edges of first portion 54 of flap 24
58 pair of longitudinal edges of first portion 54 of flap 24
60 fifth bend line
62 second portion of flap 24
64 lateral edge of second portion 62 of flap 24
66 sixth bend line

DESCRIPTION OF THE PREFERRED EMBODIMENT

Referring now to the figures, in which like numerals indicate like parts, and particularly to FIGS. 1 and 2, the pouch for a wedge-shaped cosmetic foundation sponge of the present invention is shown generally at 10 for a wedge-shaped cosmetic foundation sponge 12.

The configuration of the pouch for a wedge-shaped cosmetic foundation sponge 10 can best be seen in FIGS. 3–6, and as such, will be discussed with reference thereto.

The pouch for a wedge-shaped cosmetic foundation sponge 10 comprises a back panel 14, a pair of side panels 16 extending from the back panel 14, a front panel 18 extending across the pair of side panels 16, a bottom panel 20 extending across the pair of side panels 16, the back panel 14, and the front panel 18, a top 22 being open and extending across the pair of side panels 16, the front panel 18, and the back panel 14 for allowing entry of the wedge-shaped cosmetic foundation sponge 12, and a flap 24 selectively opening and closing the top 22.

The pouch 10 is preferably acetate with heat sealed affixed edges.

The back panel 14 is generally rectangular-shaped, and has a pair of longitudinal edges 26 and a pair of lateral edges 28.

Each side panel of the pair of side panels 16 is generally trapezoidal-shaped.

Each side panel of the pair of side panels 16 has a short longitudinal edge 30, a long longitudinal edge 32 that is longer than, and non-parallel to, the short longitudinal edge 30 of a respective side panel of the pair of side panels 16, a short lateral edge 34, and a long lateral edge 36 that is longer than, and parallel to, the short lateral edge 34 of the respective side panel of the pair of side panels 16.

The long longitudinal edge 32 of a respective side panel of the pair of side panels 16 flares outwardly from the short lateral edge 34 of the respective side panel of the pair of side panels 16 to the long lateral edge 36 of the respective side panel of the pair of side panels 16.

The short longitudinal edge 30 of one side panel of the pair of side panels 16 is integrally coincident with one longitudinal edge of the pair of longitudinal edges 26 of the back panel 14, and forms a first bend line 40 therewith, with the one side panel of the pair of side panels 16 being bent thereon perpendicularly to the back panel 14.

The long lateral edge 36 of a respective side panel of the pair of side panels 16 is coaxial with one lateral edge of the pair of lateral edges 28 of the back panel 14.

The short lateral edge 34 of the respective side panel of the pair of side panels 16 is coaxial with the other lateral edge of the pair of lateral edges 28 of the back panel 14.

The short longitudinal edge 30 of the other side panel of the pair of side panels 16 is integrally coincident with the other longitudinal edge of the pair of longitudinal edges 26 of the back panel 14, and forms a second bend line 42 therewith, with the other side panel of the pair of side panels 16 being bent thereon perpendicularly to the back panel 14.

The long lateral edge 36 of a respective side panel of the pair of side panels 16 is coaxial with one lateral edge of the pair of lateral edges 28 of the back panel 14.

The short lateral edge 34 of the respective side panel of the pair of side panels 16 is coaxial with the other lateral edge of the pair of lateral edges 28 of the back panel 14.

The front panel 18 is generally rectangular-shaped, and has a pair of longitudinal edges 44, and a pair of lateral edges 46.

One longitudinal edge of the pair of longitudinal edges 44 of the front panel 18 is coincident with the long longitudinal edge 32 of one side panel of the pair of side panels 16, and forms a third bend line 47 therewith, with the front panel 18 being bent thereon perpendicularly to the one side panel of the pair of side panels 16, and with the other longitudinal edge of the pair of longitudinal edges 44 of the front panel 18 being affixed to the long longitudinal edge 32 of the other side panel of the pair of side panels 16.

One lateral edge of the pair of lateral edges 46 of the front panel 18 is continuous with the long lateral edge 36 of the one side panel of the pair of side panels 18.

The other lateral edge of the pair of lateral edges 46 of the front panel 18 is continuous with the short lateral edge 34 of the one side panel of the pair of side panels 18.

The bottom panel 20 is generally rectangular-shaped, and has a pair of lateral edges 48 and a pair of longitudinal edges 50.

One lateral edge of the pair of lateral edges 48 of the bottom panel 20 is integrally coincident with one lateral edge 28 of the back panel 14, and forms a fourth bend line 52 therewith, with the bottom panel 20 being bent thereon perpendicularly to the back panel 14, with one longitudinal edge of the pair of longitudinal edges 50 of the bottom panel 20 being affixed to the short lateral edge 34 of one side panel of the pair of side panels 16, with the other longitudinal edge of the pair of longitudinal edges 50 of the bottom panel 20 being affixed to the short lateral edge 34 of the other side panel of the pair of side panels 16, and with the other lateral edge of the pair of lateral edges 48 of the bottom panel 20 being affixed to the other lateral edge of the pair of lateral edges 46 of the front panel 18.

One longitudinal edge of the pair of longitudinal edges 50 of the bottom panel 20 is coaxial with one longitudinal edge of the pair of longitudinal edges 26 of the back panel 14.

The other longitudinal edge of the pair of longitudinal edges 50 of the bottom panel 20 is coaxial with the other longitudinal edge of the pair of longitudinal edges 26 of the back panel 14.

The top 22 is defined by the long lateral edge 36 of one side panel of the pair of side panels 16, the long lateral edge 36 of the other side panel of the pair of side panels 16, one lateral edge of the pair of lateral edge 46 of the front panel 46, and a lateral edge of the pair of lateral edges 28 of the back panel 14.

The flap 24 has a first portion 54 that is generally rectangular-shaped, and has an area substantially equal to that of the open top 24, a pair of lateral edges 56, and a pair of longitudinal edges 58.

One lateral edge of the pair of lateral edges 56 of the first portion 54 of the flap 24 is integrally coincident with one lateral edge of the pair of lateral edges 28 of the back panel 14, and forms a fifth bend line 60 therewith, with the first portion 54 of the flap 24 being bendable thereon, to selectively cover the top 22.

One longitudinal edge of the pair of longitudinal edges 58 of the first portion 54 of the flap 24 is coaxial with one longitudinal edge 26 of the back panel 14.

The other longitudinal edge of the pair of longitudinal edges 58 of the first portion 54 of the flap 24 is coaxial with the other longitudinal edge 26 of the back panel 14.

The flap 24 further has a second portion 62 that has a lateral edge 64 that is integrally coincident with one lateral edge of the pair of lateral edges 56 of the first portion 54 of the flap 24, and forms therewith a sixth bend line 66, with the second portion 62 of the flap 24 being bendable thereon, tapered therefrom, insertable through the top 22, and frictionally positionable against the front panel 18 for maintaining the wedge-shaped cosmetic foundation sponge 12 therein.

It will be understood that each of the elements described above, or two or more together, may also find a useful application in other types of constructions differing from the types described above.

While the invention has been illustrated and described as embodied in a pouch for a wedge-shaped cosmetic foundation sponge, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed:

1. A pouch for a wedge-shaped cosmetic foundation sponge, comprising:

A) a back panel;

B) a pair of side panels extending from said back panel;

C) a front panel extending across said pair of side panels;

D) a bottom panel extending across said pair of side panels, said back panel, and said front panel;

E) a top being open and extending across said pair of side panels, said front panel, and said back panel for allowing entry of the wedge-shaped cosmetic foundation sponge; and F) a flap selectively opening and closing said top, wherein said back panel is generally rectangular-shaped, and has:

i) a pair of longitudinal edges; and ii) a pair of lateral edges, wherein each side panel of said pair of side panels has:

a) a short longitudinal edge;

b) a long longitudinal edge that is longer than, and non-parallel to, said short longitudinal edge of a respective side panel of said pair of side panels;

c) a short lateral edge; and d) a long lateral edge that is longer than, and parallel to, said short lateral edge of said respective side panel of said pair of side panels.

2. The pouch as defined in claim 1, wherein said pouch is acetate with heat sealed affixed edges.

3. The pouch as defined in claim 1, wherein each side panel of said pair of side panels is generally trapezoidal-shaped.

4. The pouch as defined in claim 1, wherein said long longitudinal edge of a respective side panel of said pair of side panels flares outwardly from said short lateral edge of said respective side panel of said pair of side panels to said long lateral edge of said respective side panel of said pair of side panels.

5. The pouch as defined in claim 1, wherein said short longitudinal edge of one side panel of said pair of side panels is integrally coincident with one longitudinal edge of said pair of longitudinal edges of said back panel, and a first bend line therewith, with said one side panel of said pair of side panels being bent thereon perpendicularly to said back panel.

6. The pouch as defined in claim 1, wherein said long lateral edge of one side panel of said pair of side panels is coaxial with one lateral edge of said pair of lateral edges of said back panel.

7. The pouch as defined in claim 6, wherein said short lateral edge of one side panel of said pair of side panels is coaxial with the other lateral edge of side pair of lateral edges of said back panel.

8. The pouch as defined in claim 5, wherein said short longitudinal edge of the other said panel of said pair of side panels is integrally coincident with the other longitudinal edge of said pair of longitudinal edges of said back panel, and forms a second bend line therewith, with said other side panel of said of side panels being bent thereon perpendicularly to said back panel.

9. The pouch as defined in claim 6, wherein said long lateral edge of the other side panel of said pair of side panels is coaxial with said lateral edge of said pair of lateral edges of said back panel.

10. The pouch as defined in claim 7, wherein said short lateral edge of the other side panel of said pair of side panels is coaxial with the other lateral edge of said pair of lateral edges of said back panel.

11. The pouch as defined in claim 1, wherein said front panel is generally rectangular-shaped, and has:

a) a pair of longitudinal edges;

b) a pair of lateral edges.

12. The pouch as defined in claim 11, wherein one longitudinal edge of said pair of longitudinal edges of said front panel is coincident with said long longitudinal edge of one side panel of said pair of side panels, and forms a third bend line therewith, with said front panel being bent thereon perpendicularly to said one side panel of said pair of side panels, and with said other longitudinal edge of said pair of longitudinal edges of said front panel being affixed to said long longitudinal edge of the other side panel of said pair of side panels.

13. The pouch as defined in claim 12, wherein one lateral edge of said pair of lateral edges of said front panel is continuous with said long lateral edge of said one side panel of said pair of side panels.

14. The pouch as defined in claim 13, wherein the other lateral edge of said pair of lateral edges of said front panel is continuous with said short lateral edge of said one side panel of said pair of side panels.

15. The pouch as defined in claim 1, wherein said bottom panel is generally rectangular-shaped, and has:

a) a pair of longitudinal edges; and b) a pair of lateral edges.

16. The pouch as defined in claim 15, wherein one lateral edge of said pair of lateral edges of said bottom panel is integrally coincident with one lateral edge of said back panel, and forms a fourth bend line therewith, with said bottom panel being bent thereon perpendicularly to said back panel, with one longitudinal edge of said pair of longitudinal edges of said bottom panel being affixed to said short lateral edge of one side panel of said pair of side panels, with the other longitudinal edge of said pair of longitudinal edges of said bottom panel being affixed to said short lateral edge of the other side panel of said pair of side panels, and with the other lateral edge of said pair of lateral edges of said bottom panel being affixed to a lateral edge of said pair of lateral edges of said front panel.

17. The pouch as defined in claim 15, wherein one longitudinal edge of said pair of longitudinal edges of said bottom panel is coaxial with one longitudinal edge of said pair of longitudinal edges of said back panel.

18. The pouch as defined in claim 17, therein the other longitudinal edge of said pair of longitudinal edges of said bottom panel is coaxial with the other longitudinal edge of said pair of longitudinal edges of said back panel.

19. The pouch as defined in claim 11, wherein said top is defined by said long lateral edge of one side panel of said pair of side panels, said long lateral edge of the other side panel of said pair of side panels, one lateral edge of said pair of lateral edges of said front panel, and one lateral edge of said pair of lateral edges of said back panel.

20. The pouch as defined in claim 1, wherein said flap has a first portion that is generally rectangular-shaped, and has:

a) an area substantially equal to that of said open top;

b) a pair of longitudinal edges; and c) a pair of lateral edges.

21. The pouch as defined in claim 20, wherein one lateral edge of said pair of lateral edges of said first portion of said flap is integrally coincident with one lateral edge of said pair of lateral edges of said back panel, and forms a fifth bend line therewith, with said first portion of said flap being bendable thereon to selectively cover said top.

22. The pouch as defined in claim 20, wherein said flap further has a second portion that has a lateral edge that is integrally coincident with one lateral edge of said pair of lateral edges of said first portion of said flap, and forms therewith a sixth bend line, with said second portion of said flap being bendable thereon, tapered therefrom, insertable through said top, and frictionally positionable against said front panel for maintaining the wedge-shaped cosmetic foundation sponge therein.

* * * * *